US010234118B2

(12) United States Patent
Zhang et al.

(10) Patent No.: US 10,234,118 B2
(45) Date of Patent: Mar. 19, 2019

(54) DECORATIVE LIGHT

(71) Applicant: Gemmy Industries Corp., Coppell, TX (US)

(72) Inventors: Cheng-Chun Zhang, Shenzhen (CN); Lio Yenwei Chang, Lewisville, TX (US)

(73) Assignee: Gemmy Industries Corp., Coppell, TX (US)

( * ) Notice: Subject to any disclaimer, the term of this patent is extended or adjusted under 35 U.S.C. 154(b) by 0 days.

(21) Appl. No.: 16/000,514

(22) Filed: Jun. 5, 2018

(65) Prior Publication Data

US 2018/0283663 A1 Oct. 4, 2018

Related U.S. Application Data

(60) Continuation-in-part of application No. 15/860,125, filed on Jan. 2, 2018, now Pat. No. 9,989,227, which
(Continued)

(51) Int. Cl.
*F21V 17/02* (2006.01)
*F21V 21/30* (2006.01)
(Continued)

(52) U.S. Cl.
CPC ..... *F21V 21/30* (2013.01); *F21V 14/00* (2013.01); *F21V 21/06* (2013.01);
(Continued)

(58) Field of Classification Search
CPC ..... F21V 14/00; F21V 14/06; F21V 14/08; F21V 17/02; F21V 21/06; F21V 21/08;
(Continued)

(56) References Cited

U.S. PATENT DOCUMENTS 2,726,571 A 12/1955 Chang
2,959,094 A 11/1960 Kosma
(Continued)

FOREIGN PATENT DOCUMENTS

CN 202675014 U 1/2013
CN 203052473 U 7/2013
(Continued)

OTHER PUBLICATIONS

Notice of Allowance dated Feb. 27, 2015 in U.S. Appl. No. 14/079,628.
(Continued)

*Primary Examiner* — Jason M Han
(74) *Attorney, Agent, or Firm* — Michele V. Frank; Venable LLP

(57) ABSTRACT

A decorative light including a beam splitter located inside a lamp case, the beam splitter defining an interior region; a lighting module located within the interior region of the beam splitter, the lighting module including a light emitting diode (LED) located thereon and a cover including a cutout, pattern, or image, the cover aligned with the LED; and a motor located inside the lamp case and configured to rotate the beam splitter. The light beam is projected from the LED and through the cover to generate a light shape. The light shape is projected through the beam splitter onto an exterior surface. A method for projecting a light shape with a decorative light is also discussed.

11 Claims, 11 Drawing Sheets

Related U.S. Application Data is a division of application No. 15/018,458, filed on Feb. 8, 2016, now Pat. No. 9,890,938.

(51) Int. Cl.

| | |
|---|---|
| ***F21V 21/06*** | (2006.01) |
| ***F21V 21/08*** | (2006.01) |
| ***F21V 14/00*** | (2018.01) |
| *F21Y 115/15* | (2016.01) |
| *F21W 131/10* | (2006.01) |
| *F21W 121/00* | (2006.01) |
| *F21S 10/02* | (2006.01) |
| *F21Y 101/00* | (2016.01) |

(52) U.S. Cl.
CPC ..... *F21V 21/0824* (2013.01); *F21S 10/02* (2013.01); *F21V 17/02* (2013.01); *F21W 2121/00* (2013.01); *F21W 2131/10* (2013.01); *F21Y 2101/00* (2013.01); *F21Y 2115/15* (2016.08)

(58) Field of Classification Search
CPC .. F21V 21/0824; F21V 21/30; F21W 2131/10
USPC ..... 362/153, 382, 418, 431, 449
See application file for complete search history.

(56) References Cited

U.S. PATENT DOCUMENTS

| | | | |
|---|---|---|---|
| 3,263,069 | A | 7/1966 | Krucki et al. |
| 3,767,299 | A | 10/1973 | Fisher |
| 3,949,350 | A | 4/1976 | Smith |
| 4,107,764 | A | 8/1978 | Riley |
| 4,249,331 | A | 2/1981 | Vernon |
| 4,307,528 | A | 12/1981 | Dewees et al. |
| 4,779,176 | A | 10/1988 | Bornhorst |
| 4,858,079 | A | 8/1989 | Ohashi |
| 4,870,548 | A | 9/1989 | Beachy et al. |
| 5,041,947 | A | 8/1991 | Yuen et al. |
| 5,084,803 | A | 1/1992 | Lan |
| 5,178,454 | A | 1/1993 | Lai |
| 5,247,492 | A | 9/1993 | Pan |
| 5,324,224 | A | 6/1994 | Anderson et al. |
| D365,169 | S | 12/1995 | Fillipp |
| 5,517,264 | A | 5/1996 | Sutton |
| 5,555,658 | A | 9/1996 | Yu |
| D377,844 | S | 2/1997 | Gary et al. |
| 5,688,042 | A | 11/1997 | Madadi et al. |
| D414,579 | S | 9/1999 | Denison et al. |
| 6,011,650 | A | 1/2000 | Parker et al. |
| 6,050,697 | A | 4/2000 | Bennington |
| D450,339 | S | 11/2001 | Eason |
| 6,361,192 | B1 | 3/2002 | Fussell et al. |
| 6,431,719 | B1 | 8/2002 | Lau et al. |
| 6,474,837 | B1 | 11/2002 | Belliveau |
| 6,478,453 | B2 | 11/2002 | Lammers et al. |
| 6,558,022 | B2 | 5/2003 | Kawahara |
| 6,584,713 | B2 | 7/2003 | Huang |
| D495,444 | S | 8/2004 | Lam |
| 6,786,793 | B1 | 9/2004 | Wang |
| 6,787,999 | B2 | 9/2004 | Stimac et al. |
| 7,033,037 | B2 | 4/2006 | Chen |
| 7,056,006 | B2 | 6/2006 | Smith |
| 7,063,553 | B1 | 6/2006 | Mullen |
| 7,182,472 | B2 | 2/2007 | Vitantonio et al. |
| D542,959 | S | 5/2007 | Yao |
| D546,489 | S | 7/2007 | Yuen |
| 7,296,909 | B2 | 11/2007 | Van Deursen et al. |
| D559,091 | S | 1/2008 | Skorka |
| 7,320,533 | B1 | 1/2008 | Beadle |
| 7,329,035 | B2 | 2/2008 | Feliciano |
| D574,532 | S | 8/2008 | Lee et al. |
| 7,416,308 | B2 | 8/2008 | Hermanson et al. |
| 7,458,698 | B2 | 12/2008 | Heathcock et al. |
| 7,473,002 | B1 | 1/2009 | Chen |
| 7,478,912 | B2 | 1/2009 | Black, Jr. |
| RE41,050 | E | 12/2009 | Panasewicz et al. |
| 7,717,570 | B2 | 5/2010 | Black, Jr. |
| 7,780,317 | B2 | 8/2010 | Schroll et al. |
| D623,786 | S | 9/2010 | Wessel |
| D625,871 | S | 10/2010 | Huang |
| 7,832,917 | B2 | 11/2010 | Chien |
| 7,871,192 | B2 | 1/2011 | Chien |
| 7,887,194 | B2 | 2/2011 | Ohira |
| 8,002,456 | B2 | 8/2011 | Chien |
| 8,057,045 | B2 | 11/2011 | Johnson |
| 8,128,274 | B2 | 3/2012 | Chien |
| D659,871 | S | 5/2012 | Lee et al. |
| 8,231,260 | B2 | 7/2012 | Chien |
| 8,262,252 | B2 | 9/2012 | Bergman et al. |
| 8,303,150 | B2 | 11/2012 | Chien |
| 8,408,736 | B2 | 4/2013 | Chien |
| 8,511,877 | B2 | 8/2013 | Chien |
| 8,641,230 | B1 | 2/2014 | Jiang |
| 8,714,799 | B2 | 5/2014 | Chien |
| 8,721,160 | B2 | 5/2014 | Chien |
| 8,884,501 | B2 | 11/2014 | Cho et al. |
| 9,097,909 | B2 | 8/2015 | Halushka |
| 9,157,589 | B2 | 10/2015 | Chien |
| D743,603 | S | 11/2015 | Inskeep |
| 9,395,608 | B2 | 7/2016 | Zhang |
| D770,657 | S | 11/2016 | Fang |
| D773,707 | S | 12/2016 | Lentine |
| 9,719,654 | B2 | 8/2017 | Chien |
| D798,484 | S | 9/2017 | Lentine |
| 9,909,739 | B2 | 3/2018 | Chien |
| 10,047,922 | B2 | 8/2018 | Chien |
| 2002/0105808 | A1 | 8/2002 | Ting Yup |
| 2003/0231497 | A1 | 12/2003 | Sakata et al. |
| 2004/0119951 | A1 | 6/2004 | Vitantonio et al. |
| 2004/0156117 | A1 | 8/2004 | Takaura et al. |
| 2005/0195598 | A1 | 9/2005 | Dancs et al. |
| 2005/0243560 | A1 | 11/2005 | Chen |
| 2006/0044532 | A1 | 3/2006 | Black |
| 2006/0176703 | A1 | 8/2006 | Cayton et al. |
| 2007/0008730 | A1 | 1/2007 | Hsieh |
| 2007/0097681 | A1 | 5/2007 | Chich et al. |
| 2008/0165527 | A1 | 7/2008 | VanderSchuit |
| 2008/0304289 | A1 | 12/2008 | Chien |
| 2009/0027900 | A1 | 1/2009 | Janos et al. |
| 2009/0122548 | A1 | 5/2009 | Dalsgaard |
| 2009/0185377 | A1 | 7/2009 | Johnson |
| 2009/0268466 | A1 | 10/2009 | Allegri |
| 2010/0091491 | A1 | 4/2010 | Jiang et al. |
| 2011/0051097 | A1 | 3/2011 | Lin |
| 2011/0116051 | A1 | 5/2011 | Young et al. |
| 2011/0194292 | A1 | 8/2011 | Tsai |
| 2011/0280015 | A1 | 11/2011 | Li et al. |
| 2011/0286200 | A1 | 11/2011 | Iimura et al. |
| 2012/0147608 | A1 | 6/2012 | Kawagoe et al. |
| 2012/0147609 | A1 | 6/2012 | Black et al. |
| 2012/0182743 | A1 | 7/2012 | Chou |
| 2012/0218464 | A1 | 8/2012 | Ben-Moshe et al. |
| 2012/0257418 | A1 | 10/2012 | Fields et al. |
| 2012/0300429 | A1 | 11/2012 | Jin |
| 2013/0094193 | A1 | 4/2013 | Baxter et al. |
| 2013/0135866 | A1 | 5/2013 | Souvay et al. |
| 2014/0001507 | A1 | 1/2014 | Steppel et al. |
| 2014/0056011 | A1 | 2/2014 | Clement et al. |
| 2015/0036354 | A1 | 2/2015 | Adams et al. |
| 2015/0070936 | A1 | 3/2015 | Chien |
| 2015/0131288 | A1 | 5/2015 | Zhang |
| 2016/0215961 | A1 | 7/2016 | Kjeldsen et al. |

FOREIGN PATENT DOCUMENTS

| | | |
|---|---|---|
| CN | 203070724 U | 7/2013 |
| CN | 103292217 A | 9/2013 |
| DK | PA 2013 00566 | 9/2014 |
| DK | PA 2013 70677 | 9/2014 |
| DK | PA 2013 70679 | 9/2014 |

(56) References Cited

FOREIGN PATENT DOCUMENTS

| | | | |
|---|---|---|---|
| EP | 2146139 | A1 | 1/2010 |
| EP | 1428415 | B1 | 7/2012 |
| WO | 03/026385 | A1 | 3/2003 |

OTHER PUBLICATIONS

Office Action dated Feb. 26, 2015 in U.S. Appl. No. 14/145,512.
Office Action dated Apr. 9, 2015 in U.S. Appl. No. 14/098,594.
Office Action dated Nov. 13, 2015 in U.S. Appl. No. 14/145,512.
Office Action dated Sep. 23, 2016 in U.S. Appl. No. 15/200,291.
Office Action dated Mar. 9, 2017 in U.S. Appl. No. 15/341,730.
Notice of Allowance dated Mar. 29, 2017 in Design U.S. Appl. No. 29/554,097.
Office Action issued in U.S. Appl. No. 15/341,730 dated Nov. 29, 2017.
"TSSS LED RGB Crystal Light Rotating Rainbow Color Effect Stage Disco DJ Wedding Family Birthday Children Celebration Event Home Party Lighting Effect," Amazon.com, Retrieved from the Internet on Dec. 19, 2017, 8 pages, URL: https://www.amazon.com/gp/product/B00B1YOENI/ref=oh_aui_detailpage_o00_s00?ie=UTF8&psc=1.
Notice of Allowance dated Dec. 11, 2017 in U.S. Appl. No. 29/607,096.

DECORATIVE LIGHT

CROSS-REFERENCE TO RELATED APPLICATIONS

This application is a continuation-in-part of U.S. patent application Ser. No. 15/860,125, filed Jan. 2, 2018, which is a divisional of U.S. patent application Ser. No. 15/018,458, filed Feb. 8, 2016, which are hereby incorporated by reference in their entirety.

TECHNICAL FIELD

The present application relates generally to a decorative light, such as a decorative outdoor spotlight, and related methods. More specifically, the present application relates to a decorative outdoor spotlight that has a dynamic lighting effect, and related methods.

BACKGROUND

Lighting is often used during the holidays, such as Christmas or Halloween, to decorate a person's house or yard. For example, a person can install one or more decorative outdoor spotlights on their yard to project decorative patterns onto their house, trees, or decorations. Examples of decorative outdoor spotlights are described in Applicant's co-owned U.S. Pat. No. 9,068,726 and U.S. Patent Application Publication No. 2015-0159842, the entire contents of which are incorporated herein by reference.

SUMMARY

According to an embodiment, a decorative light can include a beam splitter located inside a lamp case, the beam splitter defining an interior region; a lighting module located within the interior region of the beam splitter, the lighting module including a light emitting diode (LED) located thereon and a cover including a cutout, pattern, or image, the cover aligned with the LED; and a motor located inside the lamp case and configured to rotate the beam splitter. A light beam is projected from the LED and through the cover to generate a light shape, and wherein the light shape is projected through the beam splitter onto an exterior surface.

According to an embodiment, a method of projecting a light shape with a decorative light can include providing a decorative light, the decorative light including a beam splitter and a lighting module located within an interior region of the beam splitter; rotating the beam splitter with a motor; projecting a light beam from one or more LEDs through one or more covers aligned with the one or more LEDS to generate one or more light shapes; and projecting the one or more light shapes through the rotating beam splitter to generate a moving light shape on an exterior surface.

BRIEF DESCRIPTION OF THE DRAWINGS

The foregoing aspects and other features and advantages of the invention will be apparent from the following drawings, wherein like reference numbers generally indicate identical, functionally similar, and/or structurally similar elements.

DETAILED DESCRIPTION

Embodiments of the invention are discussed in detail below. In describing embodiments, specific terminology is employed for the sake of clarity. However, the invention is not intended to be limited to the specific terminology so selected. A person skilled in the relevant art will recognize that other equivalent parts can be employed and other methods developed without departing from the spirit and scope of the invention. All references cited herein are incorporated by reference as if each had been individually incorporated.

Figure 1:
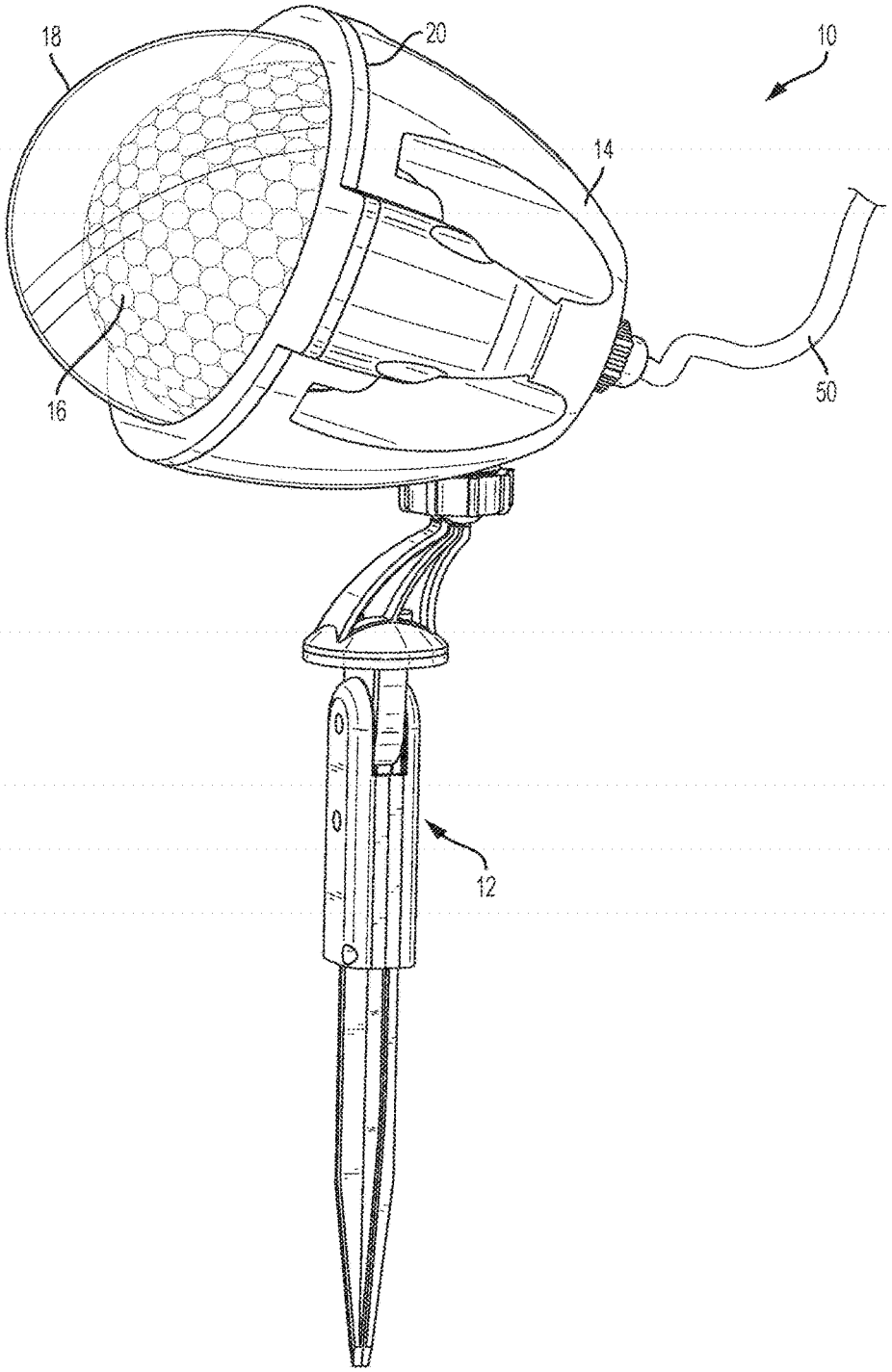
FIG. 1 is a perspective view of a decorative light according to an embodiment of the present application, shown with a support base in a collapsed configuration.
Figure 2:
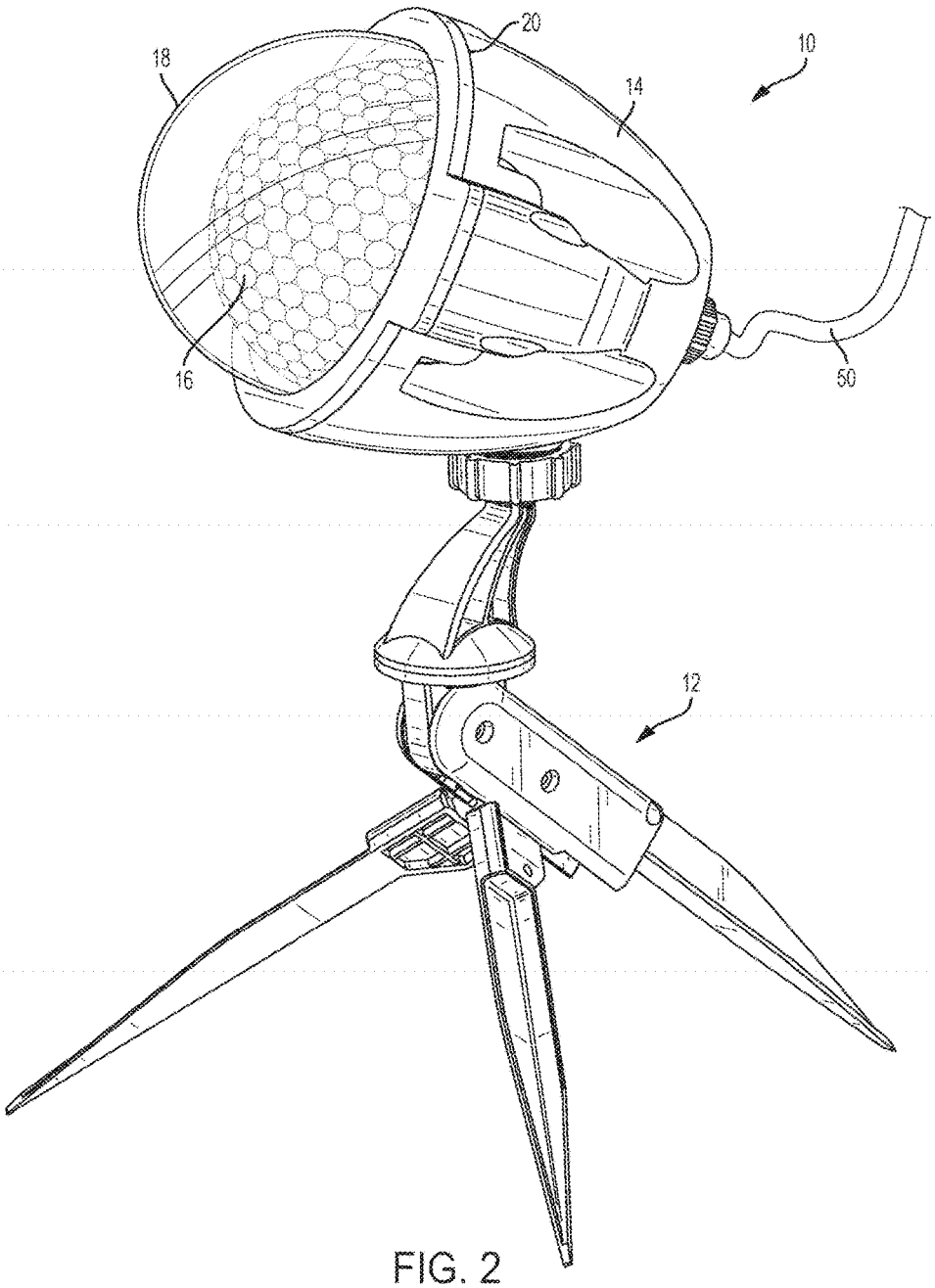
FIG. 2 is a perspective view of the decorative light of FIG. 1, shown with the support base in an expanded configuration.
Figure 3:
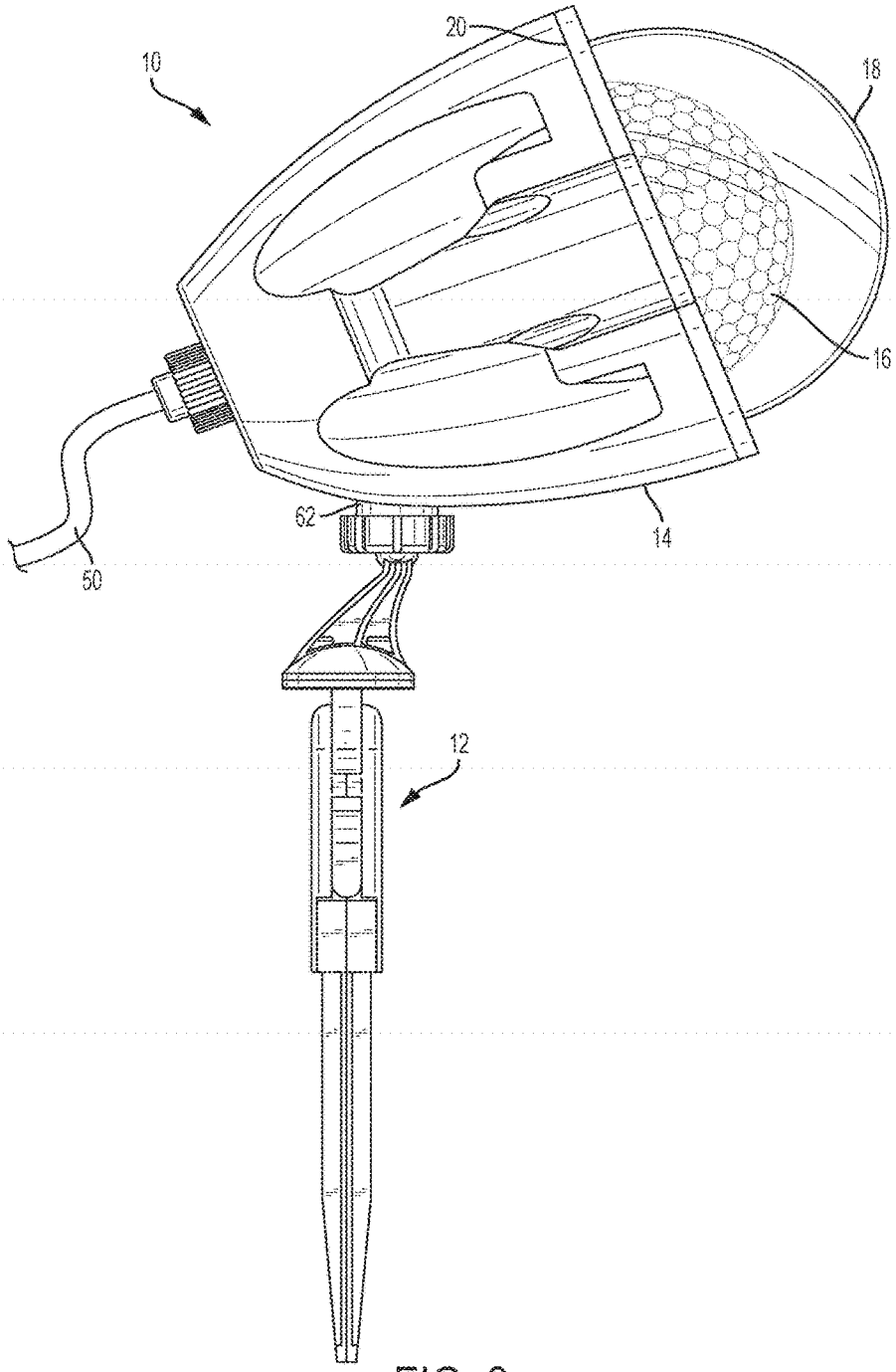
FIG. 3 is a side view of the decorative light of FIG. 1.
Figure 4:
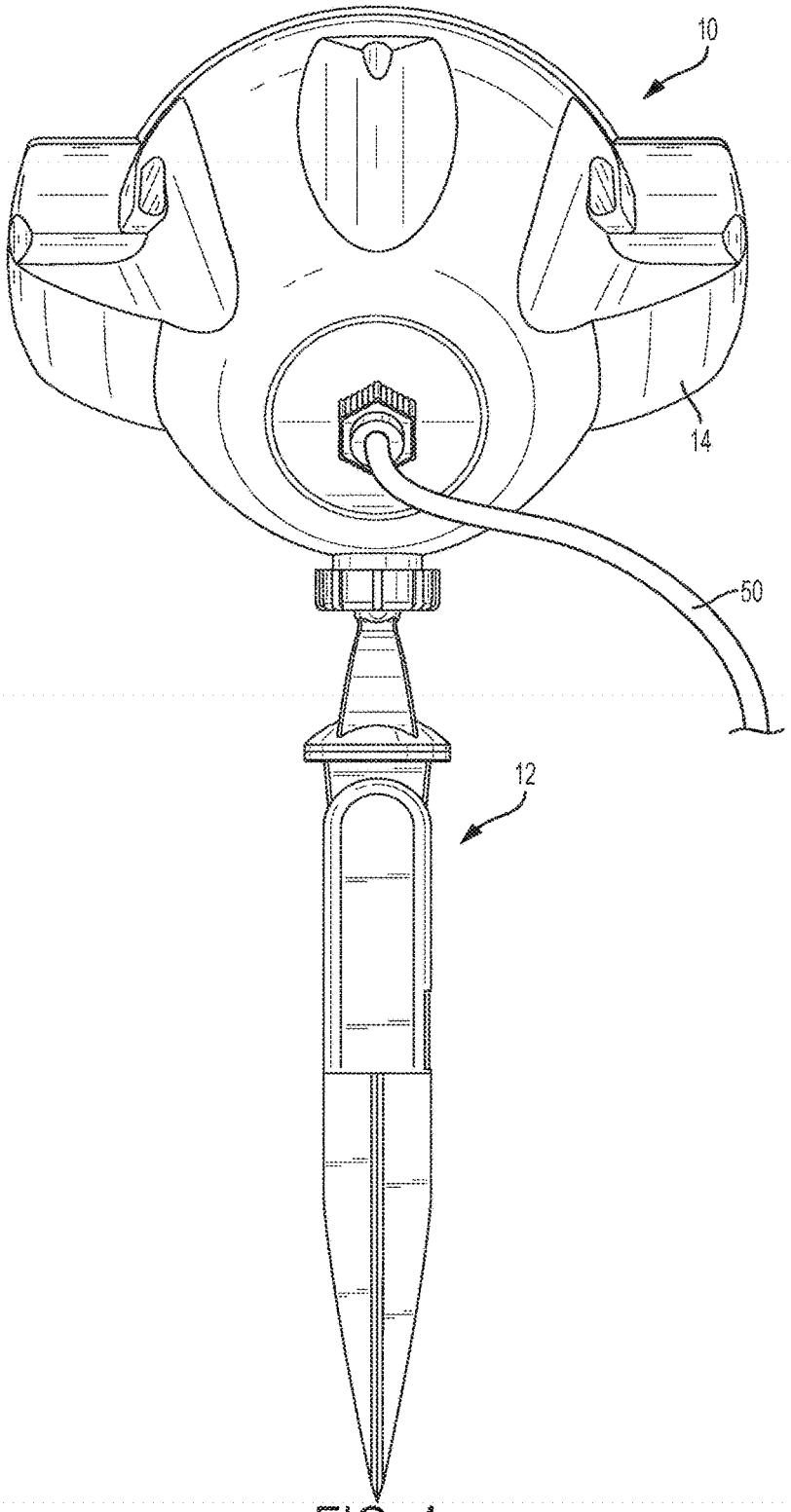
FIG. 4 is a rear view of the decorative light of FIG. 1.

Referring to FIGS. 1-4, an embodiment of a decorative light 10 according to the present invention is shown. FIGS. 1, 3, and 4 depict perspective, side, and rear views of the decorative light 10, respectively. In FIGS. 1, 3, and 4, the decorative light 10 includes a support base 12 in a collapsed configuration. FIG. 2 depicts a perspective view of the decorative light 10, with the support base 12 in an expanded configuration. The decorative light 10 can be used inside or outside to provide decorative effects. For example, the structures described below provide decorative light 10 with the ability to project a dynamic (e.g., moving) pattern of multi-colored light beams. One or more of the decorative lights 10 can be used to provide dynamic lighting of a person's house, landscaping, outdoor decorations, or the like.

Still referring to FIGS. 1-4, the decorative light 10 can include a lamp case 14, a beam splitter 16 located inside the lamp case 14, and a front lens 18 mounted to the lamp case 14, for example, to an open front end 20. The lamp case 14 can be made of plastic or other suitable material, such as metal. The beam splitter 16 and/or front lens 18 can also be formed from plastic or other suitable material and, according to embodiments, are transparent or translucent. The major components of the base 12 can also be made of plastic or other suitable material, and are described in more detail below.

Figure 5:
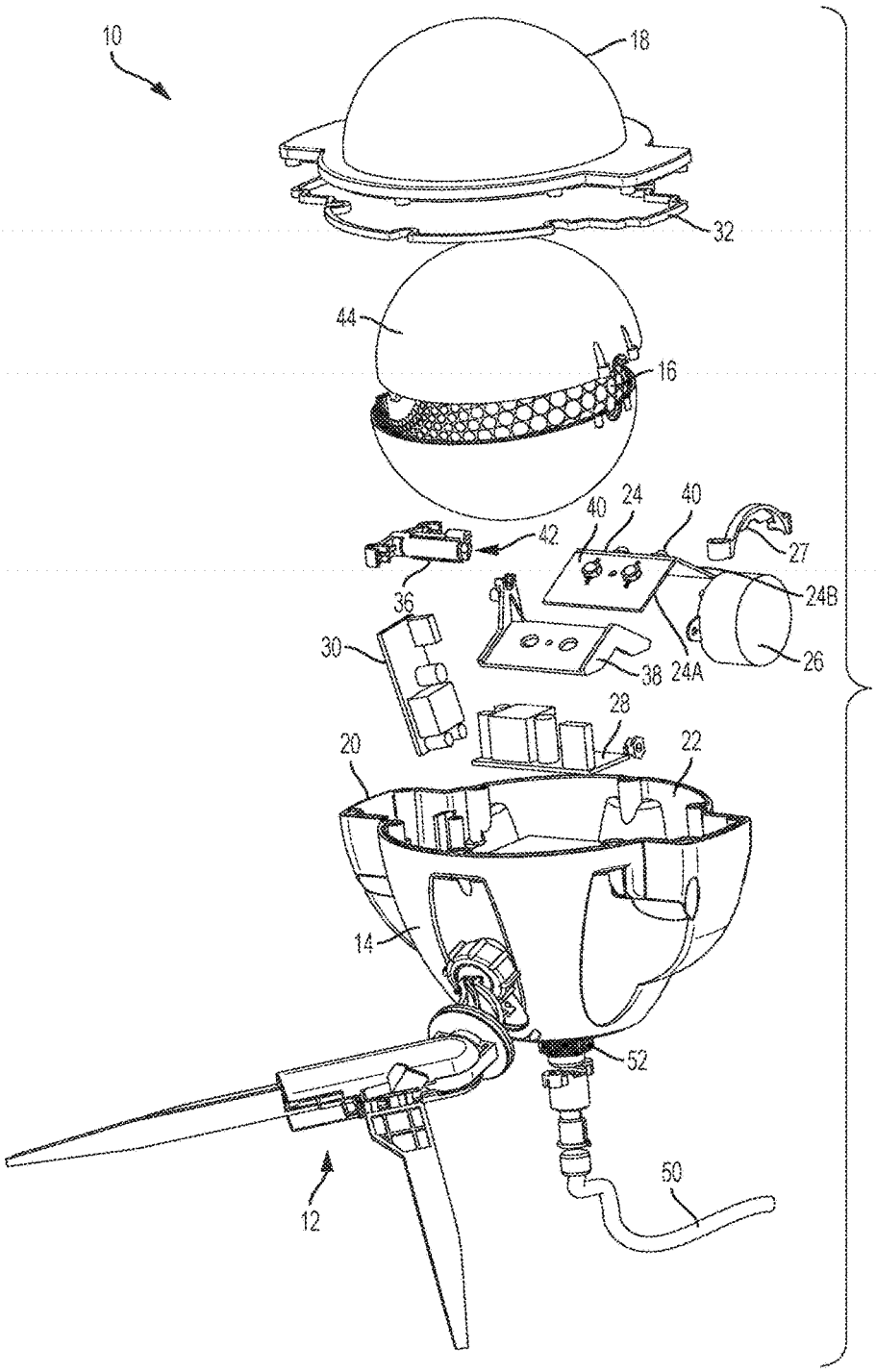
FIG. 5 is an exploded view of the decorative light of FIG. 1.
Figure 6:
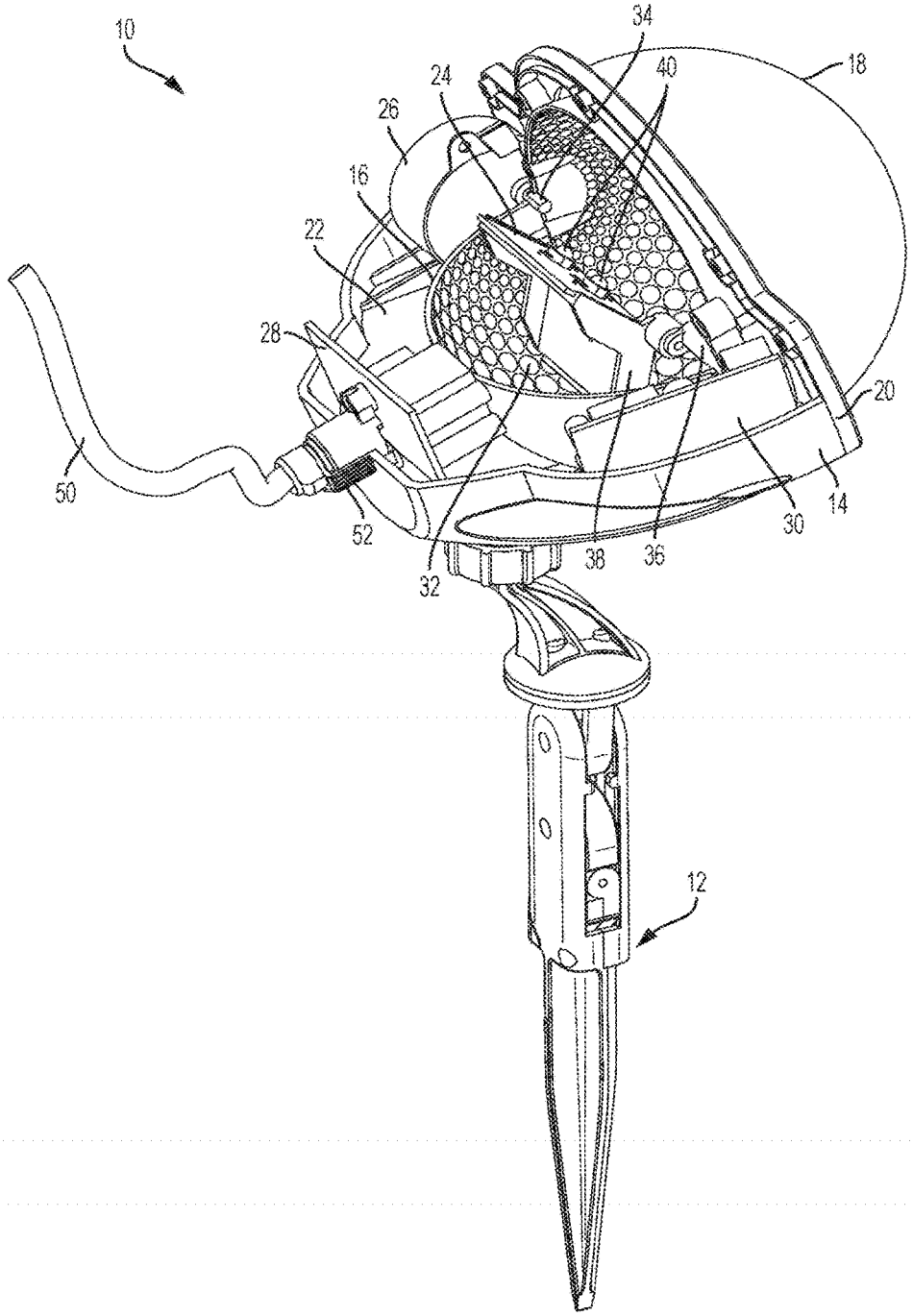
FIG. 6 is a perspective view of the decorative light of FIG. 1, shown with portions removed to reveal internal features.

Referring to FIGS. 5 and 6, the interior components of the decorative light 10 are shown. The lamp case 14 can define a hollow interior region 22 that houses the various internal components of the light. The lamp case 14 can terminate in an open front end 20, which, according to embodiments, defines a perimeter that lays within a reference plane. The beam splitter 16 and a lighting module 24, both described in more detail below, can be housed within the lamp case 14. A motor 26, power supply 28, and control unit 30 can also be housed within the lamp case 14. The front lens 18 is coupled to the open front end 20 of the lamp case 14, for example, using screws or other fasteners, adhesives, snap connections, or other fastening techniques known to one of skill in the art. The front lens 18 can form a watertight seal with the lamp case 14, for example, through the use of a rubber gasket 32 disposed between the front lens 18 and open front end 20, however, other known structures can be used to provide a waterproof seal.

The beam splitter 16 can define a hollow interior region 32 (see cutaway view of FIG. 6) that can house the lighting module 24. The motor 26 can be configured to rotate the beam splitter 16 while the lighting module 24 remains stationary within the interior region 32, creating a dynamic lighting effect. For example, the motor 26 can be located to the side of the beam splitter 16, and can include an output spindle 34 (see FIG. 6) that engages the beam splitter 16. An axle 36 (see FIG. 7) can be mounted to the lamp casing 14 on the opposite side of the motor 26, and can have a portion that extends through a bore in the beam splitter 16. The axle 36 and output spindle 34 can together support the beam splitter 16 for rotation within the lamp case 14. Thus, when the motor 26 is energized, the output spindle 34 can cause the beam splitter 16 to rotate within the lamp case 14, for example, about an axis that is substantially parallel to the reference plane of the open front end 20 of the lamp case 14. According to alternative embodiments, the beam splitter 16 can rotate about a different axis, such as, for example, about an axis substantially perpendicular to the reference plane, or about an axis that is located at an acute angle with respect to the reference plane. As shown in FIG. 5, the motor 26 can be secured within the lamp case 14 using a motor mounting bracket 27 fastened to the lamp case 14 with screws or other fasteners, however, other techniques for securing the motor 26 within the lamp case 14 are also possible.

Still referring to FIGS. 5 and 6, a lighting module support 38 can be connected to an end of the axle 36 located within the beam splitter 16. The lighting module support 38 can thus remain stationary within the beam splitter 16 during rotation of the beam splitter 16. The lighting module 24 is mounted to the lighting module support 38, for example, using adhesive, screws or other fasteners, or other fastening techniques known in the art. A plurality of light emitting diodes (LEDs) 40, or other light sources, can be mounted to the lighting module 24. All or a portion of the axle 36 can define a hollow interior channel 42 to permit passage of electrical wires from the power source 28, which can be located exterior to the beam splitter 16, to the LEDs located within the beam splitter 16. In operation, each of the LEDs can project the same color light, or alternatively, each LED, or subsets of the LEDs, can display different colors.

Referring to FIG. 5, the lighting module 24 can include first and second faces 24*a*, 24*b* (e.g., separate circuit boards) that are angled with respect to one another, for example, in a prism or pyramid shape. At least one LED 40 can be mounted on each of the faces 24*a*, 24*b*, such that the LEDs 40 are angled with respect to one another. This configuration can increase the width of the light beam projected by the lighting module 24, and in turn, the decorative light 10. Although the figures show four LEDs 40, alternative embodiments can have more or fewer LEDs 40 arranged in various patterns and groupings.

Still referring to FIG. 5, the beam splitter 16 can be substantially globe-shaped. As discussed previously, the beam splitter 16 can define a substantially hollow interior region. A plurality of facets can be distributed about the inner and/or outer surface of the beam splitter 16, for example, in order to create a dimpled surface on the beam splitter 16. The facets can focus the light from the light module 24 into multiple individual beams that travel as the beam splitter 16 rotates with respect to the light module 24. As also shown in FIG. 5, an optional cover 44, which can be substantially transparent or translucent, can surround the beam splitter 16. As shown, the cover 44 can closely conform to the outer shape of the beam splitter 16. As also shown in FIG. 5, the front lens 18 can be substantially dome shaped, however, other configurations are possible.

Referring again to FIGS. 5 and 6, the power supply 28 can receive power from an external power source, such as a standard 110V AC power outlet. In this regard, a power cord 50 can extend through lamp case 14, for example, through a waterproof bushing 52. Although not shown, the power cord 50 can include a conventional plug to couple with the power outlet. Alternatively, the power cord 50 can include a plug to connect to a DC power source, such as a car battery. The power supply 28 can also provide power, e.g., DC power, to the light module 24, motor 26, and control unit 30, for example, using electrical wires (not shown). In the case where the power supply 28 connects to the AC power source, the control unit can be adapted to convert the AC power from the source into DC power to operate the components of the decorative light 10. The control unit 30 can be used to turn the decorative light on or off, to change the color and/or intensity of light emitted by the various LEDs 40 in the lighting module 24, and to adjust the speed of rotation of the motor 26 and in turn, the beam splitter 16. Accordingly, the control unit 30 can adjust the color(s), patterns, and speed of the light beams emitted by the decorative light 10.

Figure 7:
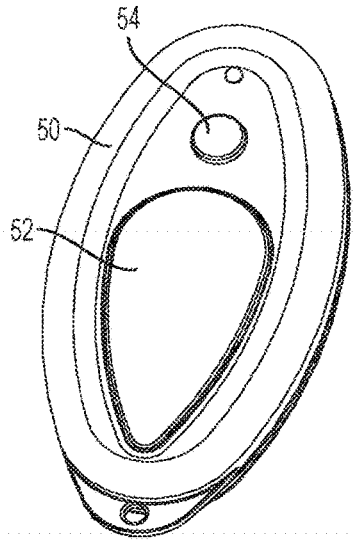
FIG. 7 is a perspective view of a remote control for use with the decorative light of FIG. 1.

Referring to FIG. 7, a remote control unit 50 can be provided to remotely operate the decorative light 10. For example, the remote control unit 50 can communicate with the control unit 30 using any number of wireless communication technologies, such as infrared, radio frequency, Wi-Fi, or Bluetooth. As shown in FIG. 7, the remote control unit 50 can include an on/off button 52 to turn the decorative light 10 on or off (e.g., to cause the LEDs to turn on/off, and to simultaneously turn the motor 26 on/off). Additionally, the remote control unit 50 can include a mode button 54 to change the color pattern, intensity, speed, and other characteristics of the light beams emitted by the decorative light 10. Although not shown, user-operable controls can be located on the exterior of the decorative light 10 to perform the same or similar functions described above in connection with the remote control unit 50. These controls can be in addition to, or an alternative to, the remote control unit 50.

Figure 8:
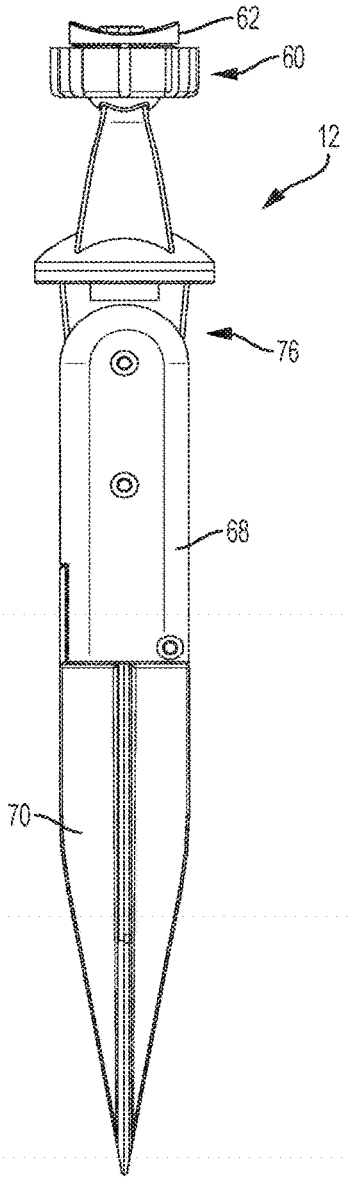
FIG. 8 is a side view of the support base of FIG. 1.
Figure 9:
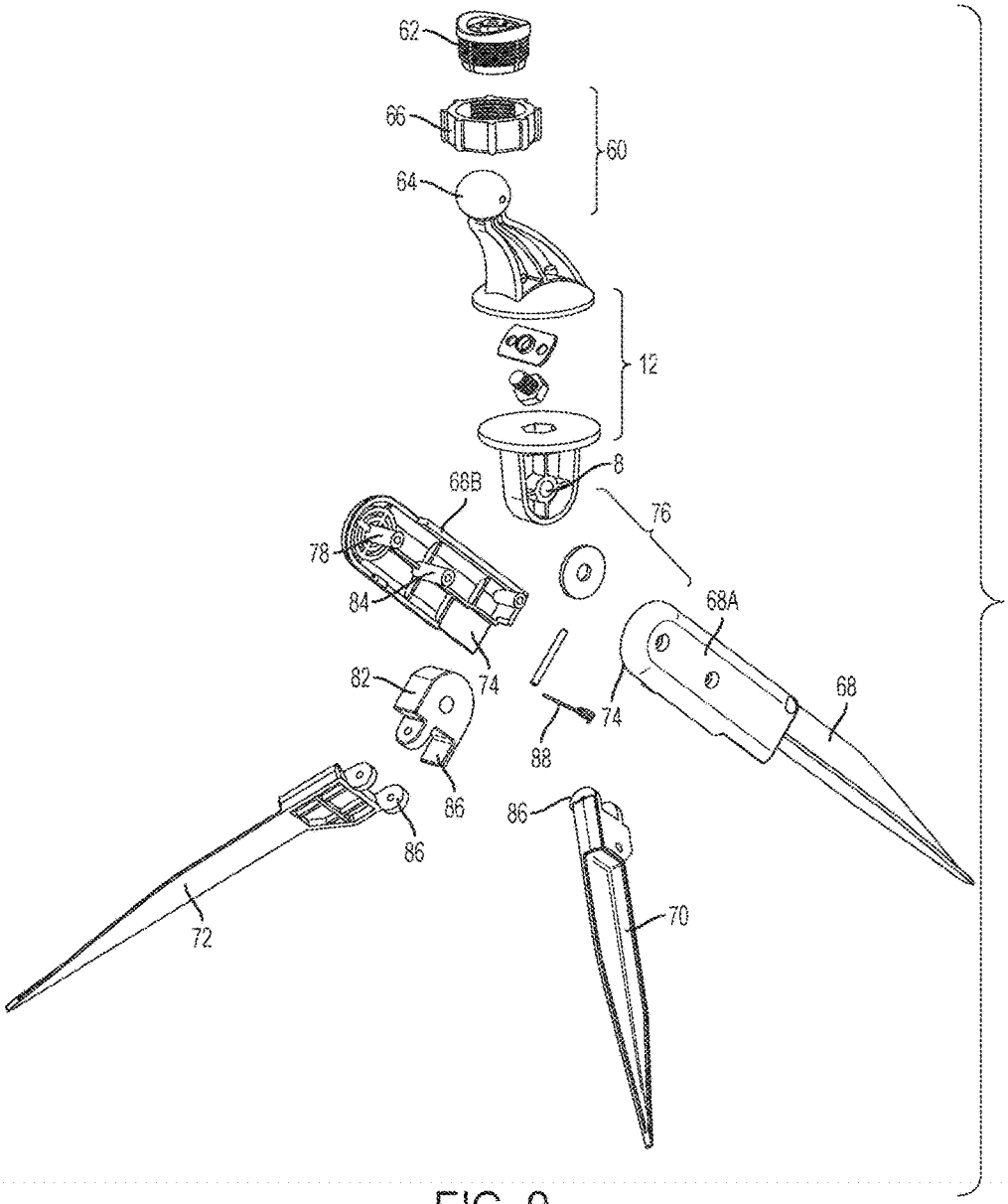
FIG. 9 is an exploded view of the support base of FIG. 8.

Referring to FIGS. 8 and 9, the support base 12 is shown separated from the decorative light 10. Although the support base 12 can be used to support the decorative light 10, it can alternatively be used to support another type of outdoor lighting product, or even another type of product altogether, such as a speaker, microphone stand, camera, or video recorder. The support base 12 can convert between a collapsed configuration (see FIGS. 1, 8) and an expanded configuration (see FIGS. 2, 9). In the collapsed configuration, the support base 12 can have the shape of a tapered post (or "spike") that can be implanted into the ground or other soft surface to maintain the support base 12 and the outdoor product attached thereto in a stable, upright position. In the expanded configuration, the constituent parts of the tapered post can be expanded into a substantially tripod shape in order to support the support base 12 and the outdoor product attached thereto in a stable position above the ground or a hard surface. Various components of the support base 12 can be constructed from plastic, composite, metal, or other material known in the art.

Referring to FIGS. 8 and 9, the support base 12 can include a head 60 that connects the support base 12 to the decorative light 10, for example, by connecting to a portion 62 of the decorative light 10 (e.g., a portion of the lamp case 14). For example, the head can include a ball joint utilizing a ball 64 and encapsulating nut 66 to provide adjustment of the decorative light with respect to the support base about multiple axes. One of skill in the art will understand, however, that other types of connections can be used to couple the support base to the decorative light.

The support base 12 can also include a primary post 68, as well as first and second auxiliary posts 70, 72. The primary post 68 can be coupled to the head 60, and the auxiliary posts 70, 72 can in turn be coupled to the primary post 68, as shown, however other configurations are possible. The primary post 68 and first and second auxiliary posts 70, 72 fit together in a "collapsed position" to form the shape of a tapered post, or spike, as shown in FIG. 8. In this position, portions of the auxiliary posts 70, 72 are substantially adjacent to the primary post 68, and extend substantially parallel to the primary post 68. As shown in FIG. 9, the primary post 68 can comprise first and second portions 68*a*, 68*b* that fit together, for example in a clamshell configuration, and define a pocket 74 that can receive a portion of each of the auxiliary posts 70, 72. A pivot joint 76 can be located between the head 60 and the primary post 68 in order to provide additional adjustability. The pivot joint 76 can comprise a boss 78 secured through a bore 80 in the primary post 68, however, other configurations are possible.

Referring to FIG. 9, the auxiliary posts 70, 72 can move between the collapsed position and an "expanded position" (e.g., where they form a substantial tripod shape in conjunction with the primary post 68) using a multi-axis hinge mechanism. For example, the hinge mechanism can comprise a first hinge 82 connected to the primary post 68, e.g., via a boss 84. The first hinge 82 can pivot with respect to the primary post 68 about a first axis. A second hinge 86 can be located on the first hinge 82, and can connect the first and second auxiliary posts 70, 72 to the first hinge 82. The second hinge 86 provides for pivoting of the auxiliary posts 70, 72 about a second axis that is substantially perpendicular to the axis of the first hinge 82. Accordingly, the first and second auxiliary posts 70, 72 can pivot with respect to one another between a position where they abut one another (e.g., when in the collapsed position), and a position where they are angled with respect to one another about the second hinge 86 (e.g., when in the expanded position). An elastic member, such as spring 88, can be associated with the second hinge 86 to normally bias the auxiliary posts 70, 72 away from one another.

To position the support base 12 in the collapsed configuration, the first and second auxiliary posts 70, 72 and folded towards one another, e.g., about the second hinge 86 and against the force of the spring 88, until they abut one another. The auxiliary posts 70, 72 are then rotated as a unit about the first hinge 82 until the combined auxiliary posts 70, 72 abut the primary post 68. At this point, the support base 12 is in the collapsed configuration. In this configuration, a portion of each auxiliary post 70, 72 is received within the pocket 74 in the primary post 68, preventing the auxiliary posts 70, 72 from splaying outward under the force of the spring 88. A detent (not shown) can be provided on the primary post 68, and/or on at least one of the auxiliary posts 70, 72, to resist rotation of the auxiliary posts 70, 72 away from the primary post 68 about the first hinge 82. To move the support base 12 to the expanded configuration (e.g., in the substantial shape of a tripod), the auxiliary posts 70, 72 are pivoted away from the primary post 68 as a unit, about the first hinge 82. Once the auxiliary posts 70, 72 have cleared the pocket 74, the auxiliary posts 70, 72 can then splay away from one another about the second hinge 86, whereby the primary post 68 and auxiliary posts 70, 72 define a substantial tripod shape.

Figure 10:
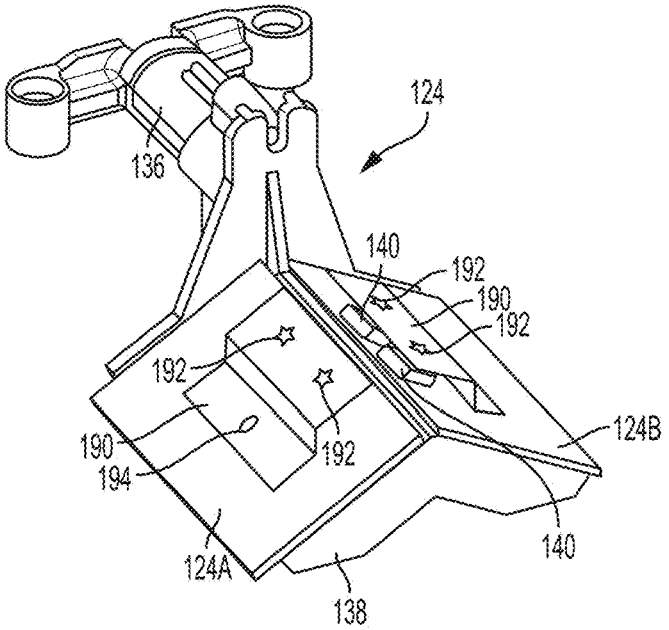
FIG. 10 is a perspective view of a lighting module, according to an embodiment.

Referring to FIG. 10, another lighting module 124 for a decorative light, such as decorative light 10, is shown. All other components of decorative light 10 can be the same, except that lighting module 124 can be used in place of lighting module 24. The lighting module 124 can be mounted in the hollow interior region 32 of the beam splitter 16 and within the hollow interior region 22 of the lamp case 14, as previously described with respect to lighting module 24 and FIGS. 5 and 6.

The lighting module 124 can remain stationary within the interior region 32 (FIG. 6) while a motor rotates the beam splitter 16, creating a dynamic lighting effect. The lighting module 124 can include an axle 136 for mounting to the lamp casing 14 (FIG. 6). The axle 136 can couple to the beam splitter 16 and operate in the same or similar manner as the axle 36. For example, the axle 136 can be mounted to the lamp casing 14 on the opposite side of the motor 26 and can have a portion that extends through a bore in the beam splitter 16. The axle 136 can, with the output spindle 34 (FIG. 6) support the beam splitter 16 for rotation within the lamp case 14, as previously described.

Still referring to FIG. 10, a lighting module support 138 can be connected to an end of the axle 136 located within the beam splitter 16. The lighting module support 138 can thus remain stationary within the beam splitter 16 during rotation of the beam splitter 16. The lighting module 124 can be mounted to the lighting module support 138, for example, using adhesive, screws or other fasteners, or other fastening techniques known in the art. A plurality of light emitting diodes (LEDs) 140, or other light sources, can be mounted to the lighting module 124. All or a portion of the axle 136 can define a hollow interior channel (not depicted) to permit passage of electrical wires from the power source to the LEDs 140. In operation, each of the LEDs 140 can project the same color light, or alternatively, each LED 140, or subsets of the LEDs 140, can display different colors.

Referring to FIG. 10, the lighting module 124 can include a first face 124*a* and a second face 124*b*. The first face 124*a* and the second face 124*b* can be separate printed circuit boards. The first face 124*a* and the second face 124*b* can each include one or more LEDs 140. The first face 124*a* and the second face 124*b* can be angled with respect to one another, for example, in a prism or pyramid shape. At least one LED 140 can be mounted on each of the faces 124*a*, 124*b*, such that the LEDs 140 are angled with respect to one another. This configuration can increase the width of the light beam projected by the lighting module 124, and in turn, the decorative light 10. Although the figures show two LEDs 140 on the second face 124*b*, alternative embodiments can have more or fewer LEDs 140 arranged in various patterns and groupings on one or both of the first face 124*a* and the second face 124*b*.

With continued reference to FIG. 10, the lighting module 124 can include one or more covers 190, such as an opaque or translucent film, or other structure that at least partially impedes light passing through the cover. Each of the first face 124*a* and the second face 124*b* can have a separate cover 190. Alternatively, the cover 190 can be an integral component extending over both the first face 124*a* and the second face 124*b*. The one or more covers 190 can be secured to the first face 124*a* and/or the second face 124*b* with one or more fasteners 194, such as a rivet. The one or more covers 190 can include one or more cutouts 192. Each cutout 192 can be aligned with each LED 140 such that the light emitting from a single LED 140 projects through the respective cutout 192 to project or display a light shape corresponding to the cutout 192. A control unit (not depicted) can adjust the color(s), patterns, and speed of the light beams emitted by the decorative light 10.

Alternatively, the one or more covers 190 can include a pattern or image on the covers 190. The pattern or image can be a portion of the cover(s) 190 that is more translucent or more opaque than the remaining portion of the cover(s) 190. The pattern or image can be an outline on the cover(s) 190. The pattern or image may be formed integral with the cover(s) 190 or secured thereto. Thus, a light beam projecting through the pattern or image can generate a light shape of the pattern or image on an exterior surface. The pattern or image on the cover(s) 190 can be aligned with the one or more LEDs 140 such that a light shape of the pattern or image can be projected onto an exterior surface when the one or more LEDs 140 are illuminated.

Figure 11:
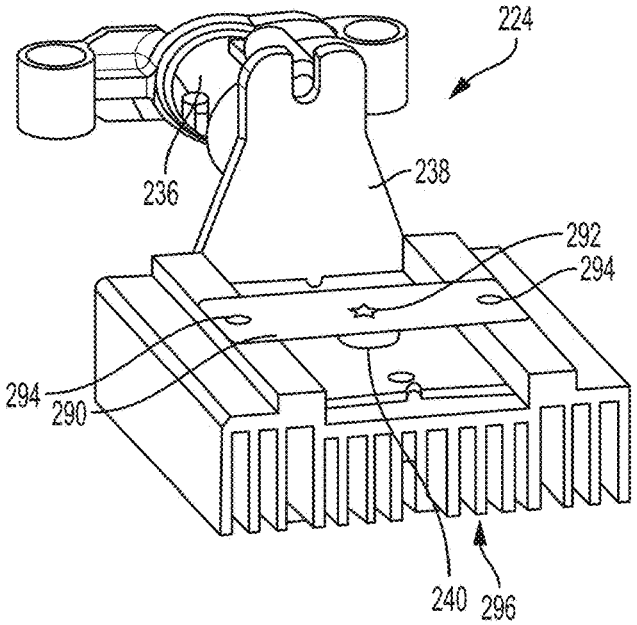
FIG. 11 is a perspective view of another lighting module, according to an embodiment.

Referring to FIG. 11, another lighting module 224 for a decorative light, such as decorative light 10, is shown. All other components of decorative light 10 can be the same, except that lighting module 224 can be used in place of lighting module 24. The lighting module 224 can be mounted in the hollow interior region 32 of the beam splitter 16 and within the hollow interior region 22 of the lamp case 14, as previously described with respect to lighting module 24 and FIGS. 5 and 6.

The lighting module 224 can remain stationary within the interior region 32 (FIG. 6) while a motor rotates the beam splitter 16, creating a dynamic lighting effect. The lighting module 224 can include an axle 236 for mounting to the lamp casing 14 (FIG. 6). The axle 236 can couple to the beam splitter 16 and operate in the same or similar manner as the axle 36. For example, the axle 236 can be mounted to the lamp casing 14 on the opposite side of the motor 26 and can have a portion that extends through a bore in the beam splitter 16. The axle 236 can, with the output spindle 34 (FIG. 6) support the beam splitter 16 for rotation within the lamp case 14, as previously described.

Still referring to FIG. 11, a lighting module support 238 can be connected to an end of the axle 236 located within the beam splitter 16. The lighting module support 238 can thus remain stationary within the beam splitter 16 during rotation of the beam splitter 16. The lighting module 224 can be a printed circuit board and can be mounted to the lighting module support 238, for example, using adhesive, screws or other fasteners, or other fastening techniques known in the art. One or more light emitting diodes (LEDs) 240, or other light sources, can be mounted to a face of the lighting module 224. All or a portion of the axle 236 can define a hollow interior channel (not depicted) to permit passage of electrical wires from the power source to the one or more LEDs 240. Although a single LED 240 is depicted, alternative embodiments can have more LEDs 240 arranged in various patterns and groupings on the lighting module face 224. In operation, where a plurality of LEDs 240 are provided, each LED 240 can project the same color light, or alternatively, each LED 240, or subsets of the LEDs 240, can display different colors.

With continued reference to FIG. 11, the lighting module 224 can include one or more covers 290, such as an opaque or translucent film, or other structure that at least partially impedes light passing through the cover. The one or more covers 290 can be secured to a face of the lighting module 224 with one or more fasteners 294, such as a rivet. The one or more covers 290 can include one or more cutouts 292. Each cutout 292 can be aligned with each LED 240 such that the light emitting from a single LED 240 projects through the respective cutout 292 to project or display a light shape corresponding to the cutout 292. A control unit (not depicted) can adjust the color(s), patterns, and speed of the light beams emitted by the decorative light 10. The lighting module 224 can include cooling fins 296 to dissipate heat associated with the operation of the decorative light and components thereof (e.g. the LEDs 240). Although the cooling fins 296 are depicted as elongated, rectangular fins, other shapes are contemplated.

Alternatively, the cover 290 can include a pattern or image on the cover 290. The pattern or image can be a portion of the cover 290 that is more translucent or more opaque than the remaining portion of the cover 290. The pattern or image can be an outline on the cover 290. The pattern or image may be formed integral with the cover 290 or secured thereto. Thus, a light beam projecting through the pattern or image can generate a light shape of the pattern or image on an exterior surface. The pattern or image on the cover 290 can be aligned with the LED 240 such that a light shape of the pattern or image can be projected onto an exterior surface when the LED 240 are illuminated.

Figure 12:
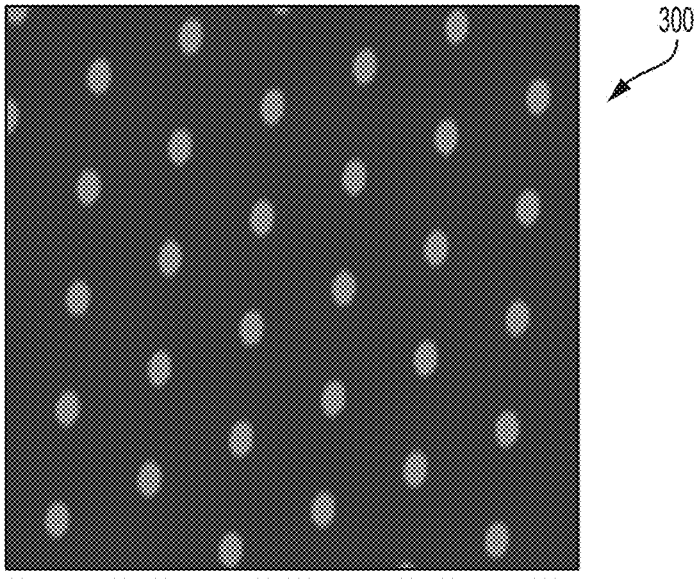
FIG. 12 is a schematic view of the light beams as projected from a decorative light, according to an embodiment.
Figure 13:
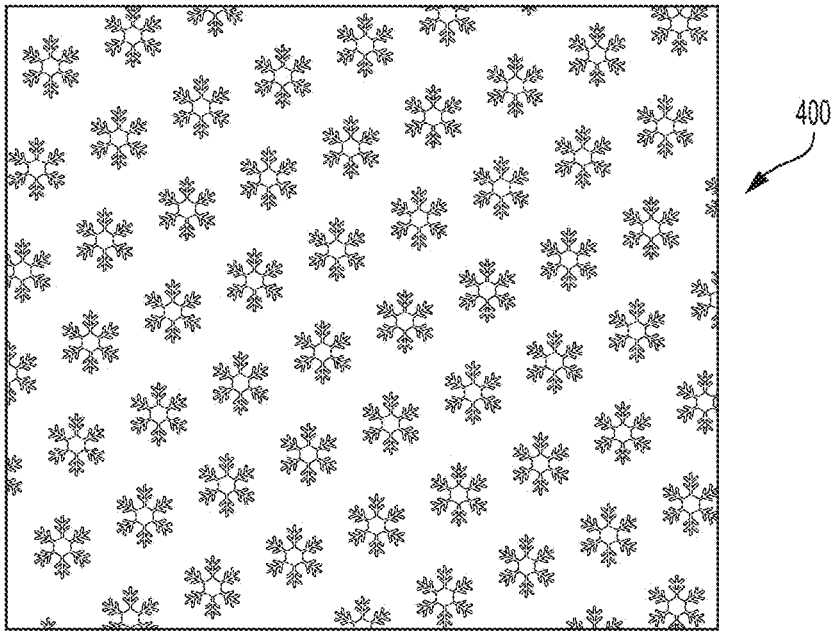
FIG. 13 is a schematic view of the light beams as projected from a decorative light, according to an embodiment.

Referring to FIGS. 12 and 13, various patterns of light beams can be depicted with the decorative light 10 and the various embodiments of the lighting module 24, 124, 224 described herein. For example, according to embodiments where no cover is provided over the LEDs, the light beams can generate a pattern of light points 300 (FIG. 12) due to the facets on the beam splitter. The facets can focus the light from the light module into multiple individual beams that travel as the beam splitter rotates with respect to the light module. The light beams may be projected on a surface, such as an exterior surface, such as a wall or building.

Alternatively, according to embodiments where the LEDs are provided with cover(s), the light beams can generate a pattern of light shapes 400 (FIG. 13) as the light beams pass through the cover(s) and then through the faceted beam splitter. The light emitted by the LEDs may exhibit a light spot (e.g. a light shape) the same as the cutout or shape on the cover(s). The light may be projected onto a surface, such as an exterior surface, such as a wall or building. For example, a light beam extending through the cover(s) may generate a light shape of the cutout. The light shape of the cutout may be focused into multiple light shapes as the light passes through the beam splitter. The light shapes may appear to move or travel as the beam splitter rotates, thus generating a moving light shape or scene on a surface.

Figure 14:
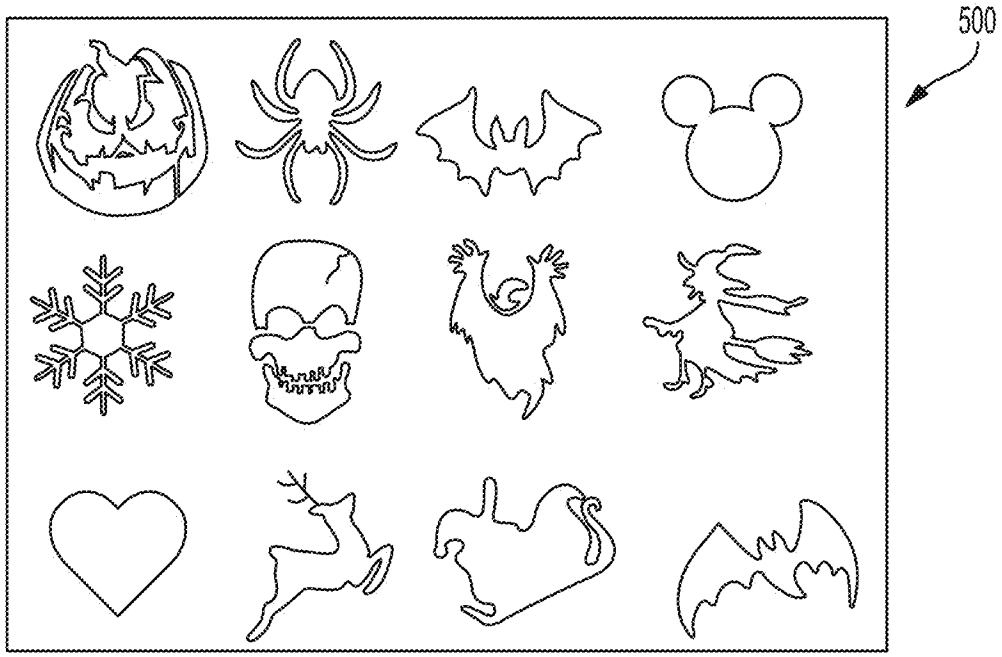
FIG. 14 is a schematic view of exemplary patterns for a decorative light, according to an embodiment.

Although snowflakes are depicted in FIG. 13, the cover(s) can include other shaped cutouts, patterns, or images. For example, but not limited to, FIG. 14 depicts exemplary shapes 500 of the cutouts, patterns, or images, 290. The cutouts, patterns or images can be one or more of a pumpkin, a jack-o-lantern, a spider, a bat, a character, a snowflake, a skull, a ghost, a witch, a heart, a reindeer, Santa, a sleigh, a bat, a star, other holiday characters, shapes, logos, etc.

According to an aspect of the invention, embodiments of the light described herein can be incorporated into an inflatable display of the type described in Applicant's U.S. Patent Application Publication No. 2015-0184844, the entire contents of which are incorporated herein by reference. According to another aspect of the invention, embodiments of the light described herein can be arranged into a light string as described in Applicant's U.S. Patent Application Publication No. 2015-0163876, the entire contents of which are incorporated herein by reference.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention can be modified or varied, without departing from the invention, as appreciated by those skilled in the art in light of the above teachings. It is therefore to be understood that, within the scope of the claims and their equivalents, the invention can be practiced otherwise than as specifically described.

The invention claimed is:

1. A decorative light, comprising:

a beam splitter located inside a lamp case, the beam splitter defining an interior region;

a lighting module located within the interior region of the beam splitter, the lighting module including a light emitting diode (LED) located thereon and a cover including a cutout, pattern, or image, the cover aligned with the LED; and a motor located inside the lamp case and configured to rotate the beam splitter, wherein a light beam is projected from the LED and through the cover to generate a light shape, and wherein the light shape is projected through the beam splitter onto an exterior surface.

2. The decorative light of claim 1, wherein the cutout, pattern, or image is one or more of a pumpkin, a jack-o-lantern, a spider, a bat, a character, a snowflake, a skull, a ghost, a witch, a heart, a reindeer, a santa, a sleigh, a bat, a star, holiday characters, a shape, or a logo.

3. The decorative light of claim 1, further comprising a plurality of LEDs and a plurality of covers, wherein each LED is aligned with each cover.

4. The decorative light of claim 3, wherein a light beam is projected from each LED and through the respective cover to generate a plurality of light shapes, and wherein the plurality of light shapes are projected through the beam splitter onto the exterior surface.

5. The decorative light of claim 1, further comprising a control unit located within the lamp case, the control unit adapted to control the color, intensity, speed, and/or on-off state of the LED.

6. The decorative light of claim 1, further comprising:

a light case housing the beam splitter; and a front lens mounted to an open front end of the light case, wherein the front lens forms a watertight seal with the open front end and wherein the front lens is substantially transparent.

7. The decorative light of claim 6, wherein the open front end of the light case defines a reference plane, and the motor is adapted to rotate the beam splitter about an axis of rotation that is substantially parallel to the reference plane.

8. The decorative light of claim 1, wherein the motor is offset to a side of the beam splitter.

9. The decorative light of claim 1, wherein the beam splitter is substantially globe shaped.

10. A method of projecting a light shape with a decorative light, the method comprising:

providing a decorative light, the decorative light including a beam splitter and a lighting module located within an interior region of the beam splitter;

rotating the beam splitter with a motor;

projecting a light beam from one or more LEDs through one or more covers aligned with the one or more LEDS to generate one or more light shapes; and projecting the one or more light shapes through the rotating beam splitter to generate a moving light shape on an exterior surface.

11. The method of claim 10, wherein the beam splitter is substantially globe shaped.

* * * * *